US006682178B2

(12) United States Patent
Yazaki

(10) Patent No.: US 6,682,178 B2
(45) Date of Patent: Jan. 27, 2004

(54) INK-JET RECORDING HEAD AND INK-JET RECORDING APPARATUS

(75) Inventor: Shiro Yazaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 143 days.

(21) Appl. No.: 10/076,348

(22) Filed: Feb. 19, 2002

(65) Prior Publication Data

US 2002/0175974 A1 Nov. 28, 2002

(30) Foreign Application Priority Data

Feb. 19, 2001 (JP) ..... 2001-041471
Jan. 29, 2002 (JP) ..... 2002-019812

(51) Int. Cl.[7] ..... B41J 2/45
(52) U.S. Cl. ..... 347/70
(58) Field of Search ..... 347/68–72

(56) References Cited

U.S. PATENT DOCUMENTS 6,074,047 A 6/2000 Hotomi et al.
6,280,642 B1 8/2001 Ikeda et al.

FOREIGN PATENT DOCUMENTS

EP 0 884 184 A1 12/1998
EP 0 919 383 A2 6/1999
JP 5-286131 11/1993
JP 2000-103062 4/2000

*Primary Examiner*—Judy Nguyen
(74) *Attorney, Agent, or Firm*—Sughrue Mion, PLLC

(57) ABSTRACT

An ink-jet recording head includes a passage-forming substrate and a plurality of piezoelectric elements provided on one side of the passage-forming substrate via an vibration plate, the passage-forming substrate having a plurality of pressure generating chambers formed therein in such a manner as to communicate with corresponding nozzle orifices and as to be separated from one another by means of a plurality of compartment walls, the plurality of piezoelectric elements each including a lower electrode, a piezoelectric layer, and an upper electrode. The vibration plate undergoes tensile stress; the number n of the pressure generating chambers arranged per inch is more than 200 and is related to width w of the pressure generating chamber and thickness d of the compartment wall as represented by (w+d)=1 inch/n; and the thickness d of the compartment wall is more than 10 $\mu$m and is related to thickness h of the passage-forming substrate as represented by $(d\times3)\leqq h\leqq(d\times6)$. Thus, the rigidity of the compartment walls is maintained.

18 Claims, 6 Drawing Sheets

INK-JET RECORDING HEAD AND INK-JET RECORDING APPARATUS

BACKGROUND OF THE INVENTION

1. Field of the Invention

The present invention relates to an ink-jet recording head configured such that a vibration plate partially constitutes a pressure generating chamber communicating with a nozzle orifice, through which a droplet of ink is ejected, and such that a piezoelectric element is provided via the vibration plate so as to eject a droplet of ink through displacing movement thereof, as well as to an ink-jet recording apparatus using the head.

2. Description of the Related Art

An ink-jet recording head is configured such that a vibration plate partially constitutes a pressure generating chamber communicating with a nozzle orifice, through which a droplet of ink is ejected, and such that a piezoelectric element causes the vibration plate to be deformed, thereby pressurizing ink contained in the pressure generating chamber and thus ejecting a droplet of ink through the nozzle orifice. Ink-jet recording heads which are put into practical use are classified into the following two types: an ink-jet recording head that employs a piezoelectric actuator operating in longitudinal oscillation mode; i.e., expanding and contracting in the axial direction of a piezoelectric element; and an ink-jet recording head that employs a piezoelectric actuator operating in flexural oscillation mode.

The former recording head has an advantage in that a function for changing the volume of a pressure generating chamber can be implemented through an end face of a piezoelectric element abutting an vibration plate, thereby exhibiting good suitability to high-density printing. However, the former recording head has a drawback in that the fabrication process is complicated; specifically, fabrication involves a difficult process of dividing the piezoelectric element into comb-tooth-like segments at intervals corresponding to those at which nozzle orifices are arranged, as well as a process of fixing the piezoelectric segments in such a manner as to be aligned with corresponding pressure generating chambers.

The latter recording head has an advantage in that piezoelectric elements can be formed on an vibration plate through a relatively simple process; specifically, a green sheet of piezoelectric material is overlaid on the vibration plate in such a manner as to correspond in shape and position to a pressure generating chamber, followed by firing. However, the latter recording head has a drawback in that a piezoelectric element must assume a certain amount of area in order to utilize flexural oscillation, thus involving difficulty in arranging pressure generating chambers in high density.

In order to solve the drawback of the latter recording head, as disclosed in, for example, Japanese Patent Application Laid-Open (kokai) No. 5-286131, the following process has been proposed. An even layer of piezoelectric material is formed on the entire surface of an vibration plate by use of a film deposition technique. By means of lithography the layer of piezoelectric material is divided in such a manner as to correspond in shape and position to pressure generating chambers, thereby forming independent piezoelectric elements corresponding to the pressure generating chambers.

In recent years, in order to realize higher-quality printing, ink-jet recording heads have been required to arrange nozzle orifice s at higher density.

However, in order to arrange nozzle orifices in high density, pressure generating chambers must be arranged in high density. High-density arrangement of pressure generating chambers causes reduction in the thickness of a compartment wall between pressure generating chambers, resulting in insufficient rigidity of a compartment wall and thus causing cross talk between adjacent pressure generating chambers.

SUMMARY OF THE INVENTION

In view of the foregoing, an object of the present invention is to provide an ink-jet recording head allowing high-density arrangement of pressure generating chambers and capable of preventing cross talk, as well as an ink-jet recording apparatus using the head.

To achieve the above object, the present invention provides an ink-jet recording head comprising a passage-forming substrate, an vibration plate, and a plurality of piezoelectric elements provided on one side of the passage-forming substrate via the vibration plate, the passage-forming substrate having a plurality of pressure generating chambers formed therein in such a manner as to communicate with corresponding nozzle orifices and as to be separated from one another by means of a plurality of compartment walls, the plurality of piezoelectric elements each comprising a lower electrode, a piezoelectric layer, and an upper electrode. The vibration plate undergoes tensile stress; the number n of the pressure generating chambers arranged per inch is more than 200 and is related to width w of the pressure generating chamber and thickness d of the compartment wall as represented by $(w+d)=1$ inch/n; and the thickness d of the compartment wall is more than 10 $\mu$m and is related to thickness h of the passage-forming substrate as represented by $(d\times3)\leqq h\leqq(d\times6)$.

Through employment of the above features, even when the pressure generating chambers are arranged in relatively high density, the rigidity of the compartment walls can be maintained, whereby good ink ejection characteristics can be maintained.

The thickness h of the passage-forming substrate and the thickness d of the compartment wall may be related as represented by $(d\times4)\leqq h\leqq(d\times5)$.

Through employment of the above feature, the rigidity of the compartment walls can be reliably maintained, whereby good ink ejection characteristics can be maintained at all times.

The percentage of compliance of the compartment wall to that of the pressure generating chamber may be not greater than 10%.

Since the percentage of compliance of the compartment wall is relatively low, the influence of cross talk can be reduced to a low level.

The thickness h of the passage-forming substrate may be more than the width w of the pressure generating chamber.

Employment of the above feature restrains a change in characteristics, which would otherwise result from an error in the thickness h of the passage-forming substrate.

Crystals of the piezoelectric layer may assume preferred orientation.

Since the piezoelectric layer is formed by a thin film deposition process, crystals assume preferred orientation.

Crystals of the piezoelectric layer may assume preferred orientation with respect to (100) planes.

When the piezoelectric layer is formed by a predetermined thin film deposition process, crystals assume preferred orientation with respect to (100) planes.

Crystals of the piezoelectric layer may be rhombohedral.

When the piezoelectric layer is formed by a predetermined thin film deposition process, crystals become rhombohedral.

Alternatively, crystals of the piezoelectric layer may be—columnar.

When the piezoelectric layer is formed by a thin film deposition process, crystals become columnar.

The piezoelectric layer may assume a thickness of 0.5 μm to 2 μm.

Since the thickness of the piezoelectric layer is relatively small, patterning in high density becomes possible.

The sum of the stress of the vibration plate and stresses of component layers of each of the piezoelectric elements may be equivalent to tensile stress.

Through employment of the above feature, a restraint which is induced at the vibration-plate-side end of each compartment wall by stresses of the piezoelectric elements and vibration plate prevents cross talk.

The sum of the stress of the vibration plate and stress of the lower electrode may be equivalent to tensile stress.

Through employment of the above feature, stresses of the vibration plate and lower electrodes function to more reliably restrain the compartment walls, thereby reliably preventing cross talk.

The piezoelectric layer may undergo tensile stress.

Through employment of the above feature, stress of the piezoelectric layer functions to more reliably restrain the compartment walls, thereby reliably preventing cross talk.

The vibration plate may comprise a compression layer undergoing compression stress on the side facing the pressure generating chambers.

Even though the vibration plate includes a compression layer, if stress of the vibration plate on the whole is tensile stress or if the sum of the stress of the vibration plate and stresses of component layers of each of the piezoelectric elements is equivalent to tensile stress, cross talk can be prevented.

When the pressure generating chambers are formed, the piezoelectric elements may be convexly warped toward corresponding pressure generating chambers.

Through employment of the above feature, stress of the vibration plate functions to more reliably prevent cross talk.

The passage-forming substrate may be formed of a monocrystalline silicon substrate and may be formed to a predetermined thickness through the other side thereof being polished.

Through employment of the above feature, the thickness of the passage-forming substrate can be reduced by means of polishing in a relatively easy manner.

The passage-forming substrate may be formed of a monocrystalline silicon substrate and may be formed to a predetermined thickness through a previously provided sacrificial substrate being removed from the other side thereof.

Through employment of the above feature, a relatively thin passage-forming substrate can be formed in a relatively easy manner.

The pressure generating chambers may be formed through anisotropic etching, and component layers of the piezoelectric elements may be formed through film deposition and lithography.

Employment of the above features allows formation of the pressure generating chambers with high precision and in high density in a relatively easy manner.

The present invention also provides an ink-jet recording apparatus comprising an ink-jet recording head as described above.

An ink-jet recording apparatus using an ink-jet recording head of the present invention can achieve high-speed, high-quality printing.

DESCRIPTION OF THE PREFERRED EMBODIMENTS

Embodiments of the present invention will next be described with reference to the drawings.

Figure 1:
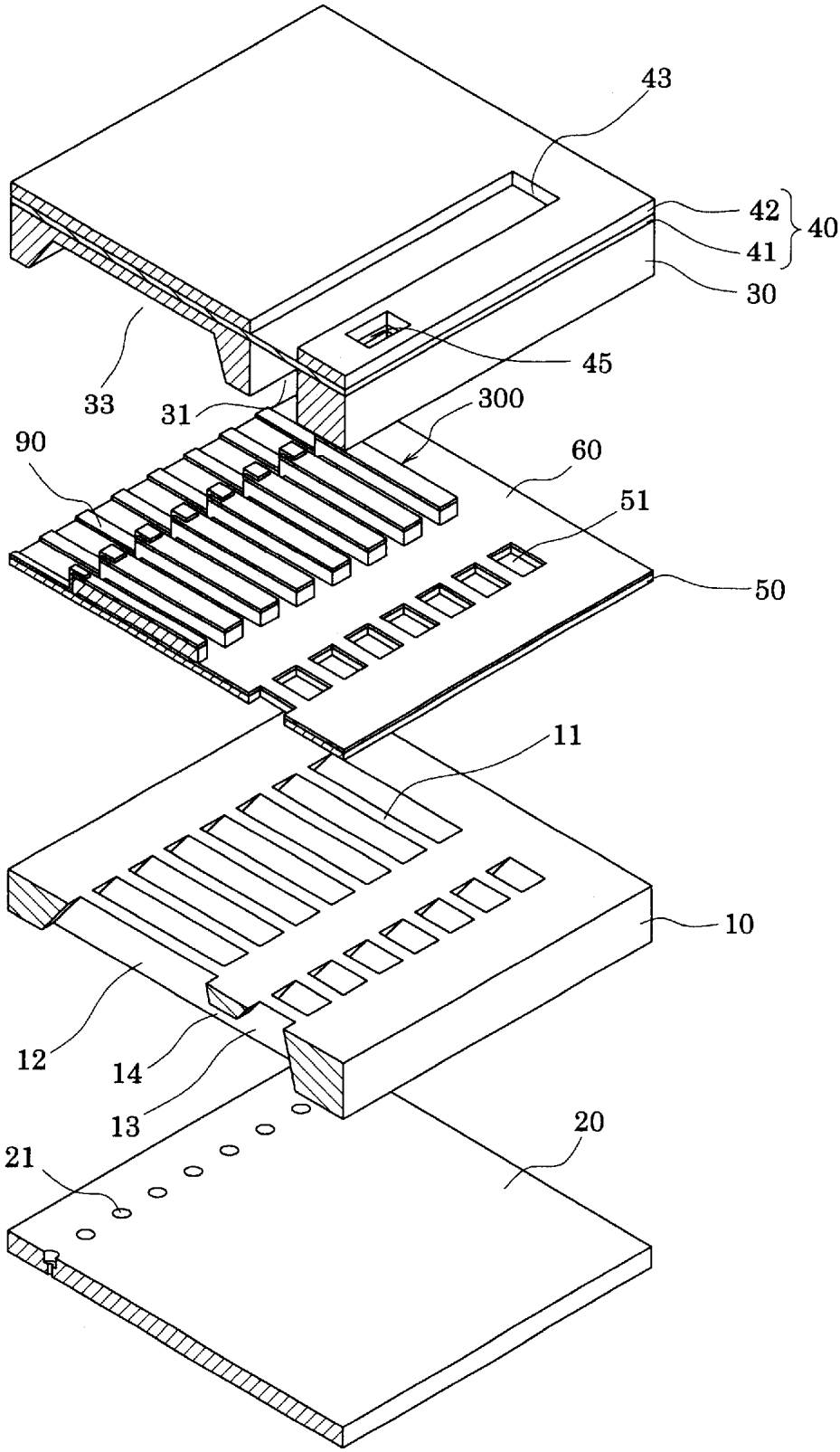
FIG. 1 is a perspective view of an ink-jet recording head according to an embodiment of the present invention.
Figure 2A:
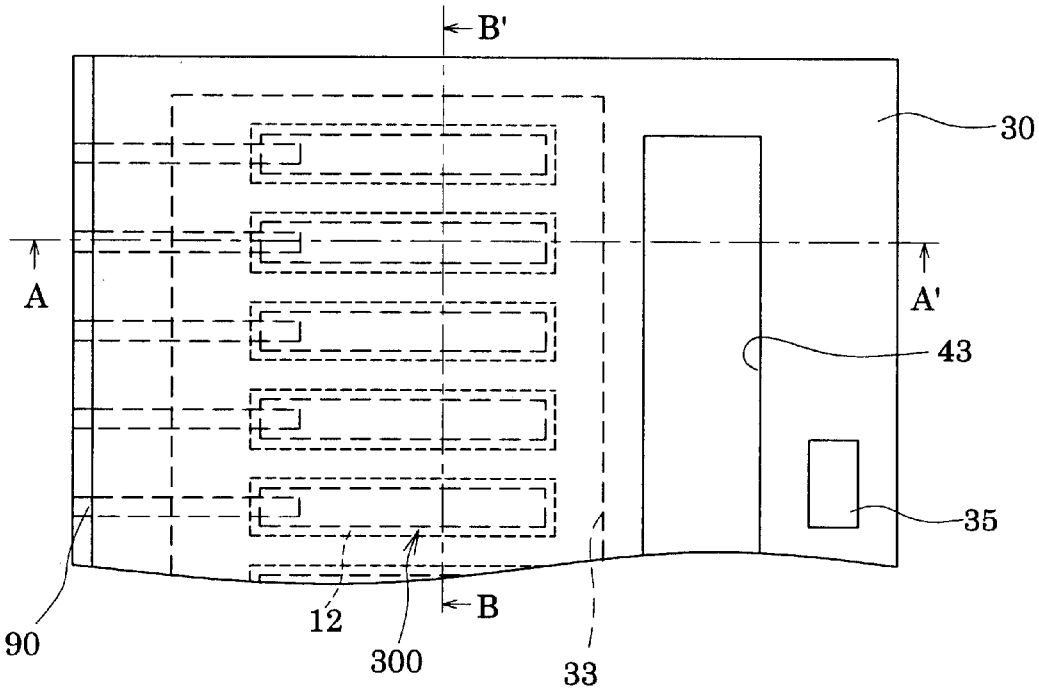
FIG. 2A is a plan view of the ink-jet recording head of FIG. 1.
Figure 2B:
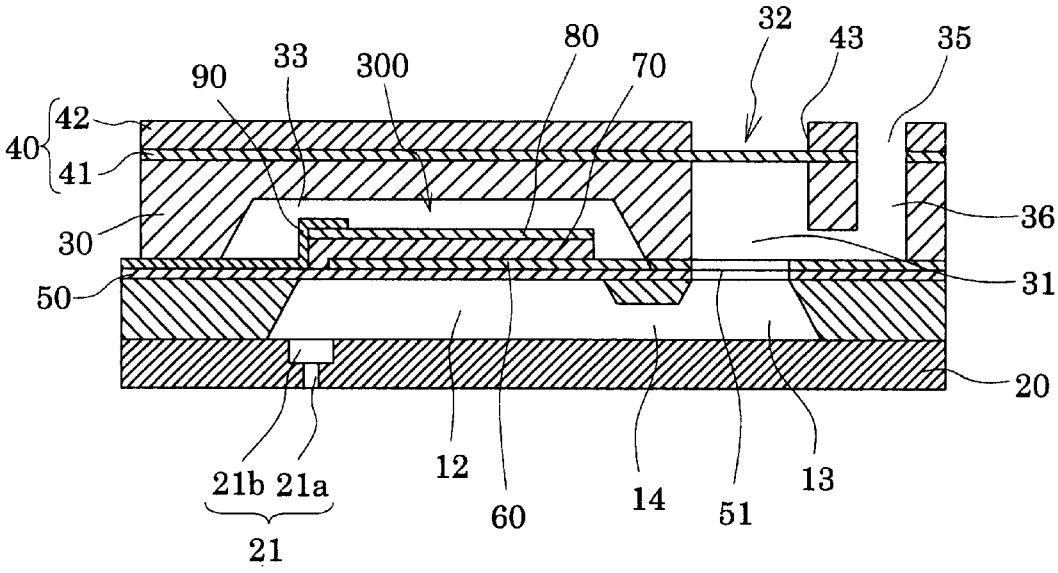
FIG. 2B is a sectional view of the ink-jet recording head taken along line A–A' of FIG. 2A.
Figure 3:
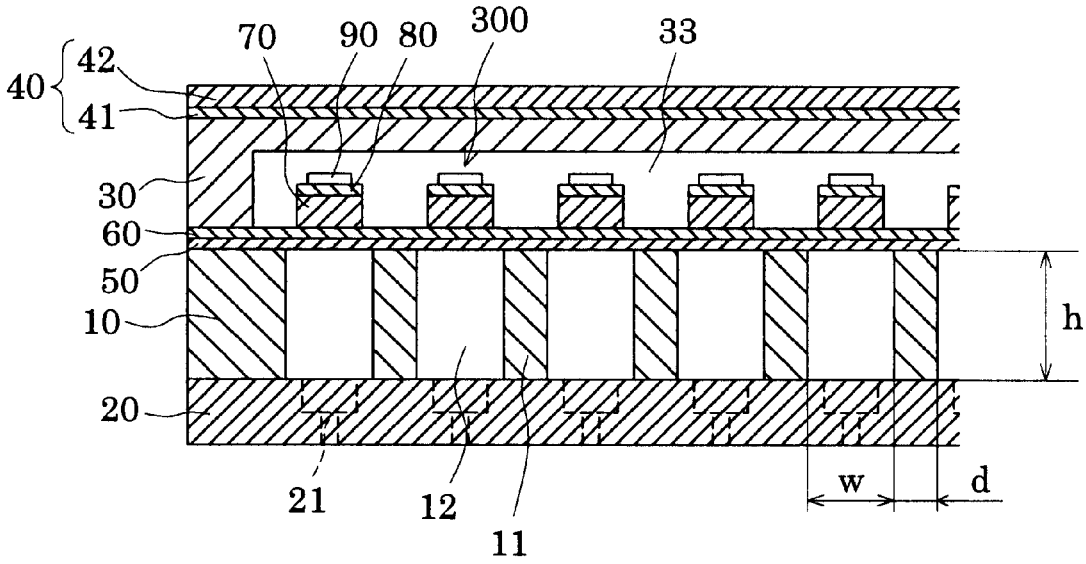
FIG. 3 is a sectional view of the ink-jet recording head taken along line B–B' of FIG. 2A.

FIGS. 1 to 3 show an ink-jet recording head according to an embodiment of the present invention. A passage-forming substrate 10 is formed of a monocrystalline silicon substrate of (110) plate orientation and includes an elastic film 50 of silicon dioxide, 1 μm to 2 μm thick, formed previously on one side thereof through thermal oxidation.

A plurality of pressure generating chambers 12 are formed in the passage-forming substrate 10 through anisotropic etching of the monocrystalline silicon substrate from one side thereof, in such a manner as to be separated from one another by means of a plurality of compartment walls 11 and as to be arranged along the width direction of the passage-forming substrate 10. A plurality of communication sections 13 are formed in the passage-forming substrate 10 at a longitudinally outward position. The communication sections 13 communicate with a reservoir 31 of a reservoir forming plate, which will be described later, through corresponding communication holes 51. The communication sections 13 communicate with the corresponding pressure generating chambers 12 at longitudinal end portions of the pressure generating chambers 12 via corresponding ink supply paths 14.

The pressure generating chambers 12 are arranged in relatively high density; for example, at more than 200 chambers per inch, and, according to the present embodiment, at 360 chambers per inch.

Anisotropic etching utilizes the following properties of a monocrystalline silicon substrate: when a monocrystalline silicon substrate is immersed in an alkaline solution, such as a KOH solution, the monocrystalline silicon substrate is gradually eroded such that there emerge the first (111) plane perpendicular to the (110) plane and the second (111) plane forming an angle of about 70 degrees with the first (111) plane and an angle of about 35 degrees with the (110) plane; and the (111) planes are etched at about 1/180 a rate at which the (110) planes are etched. An accurate process can be performed by such anisotropic etching on the basis of a depth process in a parallelogram defined by two first (111) planes and two slant second (111) planes, whereby the pressure generating chambers 12 can be arranged in high density.

According to the present embodiment, the first (111) planes define the long sides of each pressure generating chamber 12, whereas the second (111) planes define the short sides of each pressure generating chamber 12. The pressure generating chambers 12 are formed through etching the passage-forming substrate 10 along substantially the entire thickness until the elastic film 50 is reached. Notably, the elastic film 50 is slightly eroded by an alkaline solution used for etching a monocrystalline silicon substrate. The ink supply paths 14, which communicate with the corresponding pressure generating chambers 12 at one end of the chambers 12, are formed shallower than the pressure generating chambers 12 so as to maintain constant flow resistance of ink flowing into the pressure generating chambers 12. That is, the ink supply paths are formed through etching the monocrystalline silicon substrate halfway (half-etching) along the thickness direction of the substrate. Half-etching is performed through adjustment of etching time.

A nozzle plate 20 is bonded, by use of adhesive, to the opposite side of the passage-forming substrate 10 such that nozzle orifices 21 formed therein communicate with the corresponding pressure generating chambers 12 at the sides opposite the ink supply paths 14. According to the present embodiment, the nozzle plate 20 is formed of a monocrystalline silicon substrate and has a plurality of nozzle orifice 21 formed therein by dry etching. Each of the nozzle orifices 21 includes a nozzle section 21*a* through which a droplet of ink is ejected, and a nozzle communication section 21*b* having a diameter greater than that of the nozzle section 21*a* and establishing communication between the nozzle section 21*a* and the pressure generating chamber 12.

Since, as mentioned above, the nozzle plate 20 and the passage-forming substrate 10 are formed of the same material, the nozzle plate 20 and the passage-forming substrate 10 do not suffer the occurrence of warpage or stress in a heating process associated with bonding and in a post-heating process associated with mounting, thereby being free from cracking.

The size of the pressure generating chamber 12 adapted to apply ink-droplet ejection pressure to ink and the size of the nozzle orifice 21 adapted to eject ink droplets therethrough are optimized according to the amount of ink droplets to be ejected, an ink-droplet ejection speed, and an ink-droplet ejection frequency. For example, when 360 droplets of ink per inch are to be ejected for recording, the nozzle orifices 21 must be formed precisely to a diameter of several tens of micrometers.

A lower electrode film 60, a piezoelectric layer 70, and an upper electrode film 80 are formed in layers, by a process to be described later, on the elastic film 50 provided on the passage-forming substrate 10, thereby forming a piezoelectric element 300. The lower electrode film 60 assumes a thickness of, for example, about 0.2 $\mu$m; the piezoelectric layer 70 assumes a thickness of, for example, about 0.5 $\mu$m to 2 $\mu$m; and the upper electrode film 80 assumes a thickness of, for example, about 0.1 $\mu$m. Herein, the piezoelectric element 300 includes the lower electrode film 60, the piezoelectric layer 70, and the upper electrode film 80. Generally, either the lower electrode or the upper electrode assumes the form of a common electrode for use among the piezoelectric elements 300, whereas the other electrode and the piezoelectric layer 70 are formed, through patterning, for each of the pressure generating chambers 12. In this case, the portion that is constituted of any one of the electrodes and the piezoelectric layer 70, to which patterning is performed, and where piezoelectric strain is generated by application of voltage to both electrodes, is referred to as a piezoelectric active portion. According to the present embodiment, the lower electrode film 60 serves as a common electrode for use among the piezoelectric elements 300, whereas the upper electrode film 80 serves as an individual electrode for use with a piezoelectric element 300. However, the configuration may be reversed according to the needs of a drive circuit and wiring. In either case, piezoelectric active portions are formed for individual pressure generating chambers. Herein, a piezoelectric element 300 and an vibration plate, which is driven by the piezoelectric element 300 to thereby be deformed, constitute a piezoelectric actuator. According to the present embodiment, the elastic film 50 and the lower electrode film 60 serve as an vibration plate. However, a lower electrode film may also serve as an elastic film. In order to cause stress induced in the vibration plate to be tensile stress, a reinforcement layer made of, for example, zirconium oxide ($ZrO_2$) may be formed on the elastic film 50.

Preferably, an ink-jet recording head in which the number n of the pressure generating chambers 12 arranged per inch is more than 200 and is related to width w of the pressure generating chamber 12 and thickness d of the compartment wall 11 as represented by (w+d)=1 inch/n satisfies the following conditions: the vibration plate undergoes tensile stress; and the thickness d of the compartment wall 11 is more than 10 $\mu$m and is related to thickness h of the passage-forming substrate 10 (the depth of the pressure generating chamber 12) as represented by $(d\times3)\leqq h\leqq(d\times6)$, and more preferably $(d\times4)\leqq h\leqq(d\times5)$.

Thus, even when the pressure generating chambers 12 are arranged in relatively high density, the rigidity of the compartment walls 11 is reliably maintained, whereby occurrence of cross talk can be prevented. Specifically, when the pressure generating chambers 12 are arranged in high density, the thickness of the compartment walls 11 is reduced; however, the rigidity of the partitions 11 is reliably maintained through satisfying the above-mentioned requirements in determining width w of the pressure generating chamber 12, thickness d of the partition 11, and thickness h of the passage-forming substrate 10.

When the vibration plate is formed by a thin film deposition process and undergoes tensile stress, ends of the partitions 11 located on the vibration plate side can be considered not to be free ends but to be simply supported ends. In this case, satisfaction of the above-mentioned requirements reliably prevents cross talk.

According to the present invention, since the vibration plate is composed of the elastic film 50 and the lower electrode film 60, the vibration plate undergoes tensile stress; i.e., the sum of the stress of the elastic film 50 and stress of the lower electrode film 60 is equivalent to tensile stress. For example, according to the present embodiment, the elastic film 50 undergoes compression stress, and the lower electrode film 60 undergoes tensile stress, whereas the vibration plate on the whole undergoes tensile stress.

Even when the lower electrode film 60 is patterned for each piezoelectric element 300 and thus does not function as an vibration plate, the sum of the stress of the elastic film 50 serving as an vibration plate and stress of the lower electrode film 60 preferably is equivalent to tensile stress as measured in regions facing the pressure generating chambers 12. As a result of the vibration plate undergoing tensile stress, when the pressure generating chambers 12 are formed; i.e., in the initial state, preferably, the piezoelectric elements 300 are convexly warped toward the corresponding pressure generating chambers 12.

As a result of the vibration plate undergoing tensile stress, the tensile stress induces a restraint that restrains an end portion of each compartment wall 11 located on the vibration plate side, thereby preventing cross talk.

According to the present embodiment, the sum of the stress of the elastic film 50 serving as an vibration plate and stress of the lower electrode film 60 is equivalent to tensile stress, and the sum of the stress of the vibration plate and stresses of component layers of each of the piezoelectric elements 300 is equivalent to tensile stress while at least the piezoelectric layer 70 of the piezoelectric element 300 undergoes tensile stress. In this manner, preferably, the vibration plate undergoes tensile stress, and the sum of the stress of the vibration plate and stresses of component layers of each of the piezoelectric elements 300 is equivalent to tensile stress. However, when, at least, the sum of the stress of the vibration plate and stresses of component layers of each of the piezoelectric elements 300 is equivalent to tensile stress, the tensile stress functions to restrain end portions of the compartment walls 11 located on the vibration plate side, thereby preventing cross talk.

When the thickness d of the compartment wall 11 is more than 10 $\mu$m, preferably more than 10 $\mu$m and not greater than 30 $\mu$m, and is related to the thickness h of the passage-forming substrate 10 as represented by $h \leqq (d \times 6)$, the compartment walls 11 maintain predetermined rigidity to thereby reliably prevent cross talk.

The smaller the thickness h of the passage-forming substrate 10; i.e., the lower the height of the partition 11, the higher the rigidity of the partition 11, whereby cross talk can be prevented more reliably. However, since in order to obtain good ink ejection characteristics, the laterally cross-sectional area of the pressure generating chamber 12 is preferably as large as possible, the thickness h of the passage-forming substrate 10 (the depth of the pressure generating chamber 12) is preferably related to the thickness d of the compartment wall 11 as represented by $h \geqq (d \times 3)$. Also, preferably, the width w of the pressure generating chamber 12 is as large as possible.

Thus, when the thickness d of the compartment wall 11 is more than 10 $\mu$m, and is related to the thickness h of the passage-forming substrate 10 as represented by $(d \times 3) \leqq h \leqq (d \times 6)$, the compartment walls 11 maintain rigidity to thereby reliably prevent cross talk.

The above-mentioned dimensional requirements between the thickness d of the compartment wall 11 and the thickness h of the passage-forming substrate 10 (the depth of the pressure generating chamber 12) are based on the following findings in compliance. When the percentage of compliance of a compartment wall 11, which is used for separating the pressure generating chambers 12 from each other, to compliance of a pressure generating chamber 12; i.e., to the total compliance of the compartment wall 11, the vibration plate, and ink contained in the pressure generating chamber 12 is not greater than 10%, particularly not greater than 5%, occurrence of cross talk can be restrained.

The length of a short side of the lateral cross section of the pressure generating chamber 12 has a greater effect on flow resistance of the pressure generating chamber 12 than does the length of a long side of the lateral cross section. The width w of the pressure generating chamber 12 can be controlled with higher precision than the depth of the pressure generating chamber 12 (the thickness h of the passage-forming substrate 10). Thus, preferably, the short side, which has a great effect on ink ejection characteristics, is the width w of the pressure generating chamber 12. That is, preferably, the width w of the pressure generating chamber 12 is not greater than the thickness h of the passage-forming substrate 10, whereby the pressure generating chambers 12 can exhibit good, uniform ink ejection characteristics.

Ink jet recording heads of Examples 1 to 4 and Comparative Examples 1 to 3 were fabricated under the conditions shown below in Table 1. The ink jet recording heads were examined for the percentage of compliance of the compartment wall 11 to that of the pressure generating chamber 12. The results are also shown in Table 1.

TABLE 1

| | | Comparative Example 1 | Example 1 | Example 2 | Example 3 | Example 4 | Comparative Example 2 | Comparative Example 3 |
|---|---|---|---|---|---|---|---|---|
| Arrangement density of pressure generating chambers (dpi) | | 360 | 360 | 360 | 360 | 360 | 360 | 360 |
| Dimensions of pressure generating chamber | w: width ($\mu$m) | 55 | 55 | 55 | 55 | 55 | 55 | 55 |
| | h: depth ($\mu$m) | 30 | 45 | 60 | 75 | 90 | 105 | 120 |
| d: thickness of compartment wall ($\mu$m) | | 15 | 15 | 15 | 15 | 15 | 15 | 15 |
| h/d | | 2 | 3 | 4 | 5 | 6 | 7 | 8 |
| w/h | | 1.8 | 1.2 | 0.9 | 0.7 | 0.6 | 0.5 | 0.5 |
| Percentage of compliance of compartment wall | | 0.10% | 0.60% | 1.80% | 3.90% | 7.20% | 11.80% | 17.80% |

As shown in Table 1, in the Examples and the Comparative Examples, the number n of the pressure generating chambers 12 arranged per inch is 360, the sum of the width w of the pressure generating chamber 12 and the thickness d of the compartment wall 11 is about 70 $\mu$m ($(w+d) \equiv 70$ $\mu$m). Since the width w of the pressure generating chamber 12 is about 55 $\mu$m, the thickness d of the compartment wall 11 is about 15 $\mu$m.

In Examples 1 to 4, the thickness h of the passage-forming substrate 10 (the depth of the pressure generating chamber 12) was varied over the range of 45 $\mu$m to 90 $\mu$m such that the thickness d of the compartment wall 11 and the thickness h of the passage-forming substrate 10 are related as represented by $(d\times3)\leqq h\leqq(d\times6)$.

Comparative Examples 1 to 3 are similar to Examples 1 to 4 except that they assumed a thickness h of the passage-forming substrate 10 of 30 μm, 105 μm, and 120 μm, respectively.

The ink jet recording heads of Examples 1 to 4 formed to have the above-described dimensions exhibit a percentage of compliance of the compartment wall 11 of 0.6% to 7.2%, which is smaller than 10%. The ratio between the width w of the pressure generating chamber 12 and the depth of the pressure generating chamber 12 (the thickness h of the passage-forming substrate 10), w/h, is 0.6 to 1.2, indicating that the width of the pressure generating chamber 12 is substantially equal to or smaller than the depth of the pressure generating chamber 12. Thus, the ink jet recording heads do not involve cross talk and exhibit good ink ejection characteristics.

By contrast, the ink jet recording head of Comparative Example 1 has a very small percentage of compliance of the compartment wall of 0.1% and thus can prevent cross talk. However, since the ratio between the depth and the width of the pressure generating chamber, w/h, assumes a very large value of 1.8, the ink jet recording head fails to exhibit uniform ejection characteristics.

The ink jet recording heads of Comparative Examples 2 and 3 have a large percentage of compliance of the compartment wall of more than 10% and thus involve cross talk, resulting in a failure to exhibit good ink ejection characteristics.

As seen from the examination results as described above, when the thickness d of the compartment wall 11 and the thickness h of the passage-forming substrate 10 are determined as represented by $(d\times3)\leqq h\leqq(d\times6)$, particularly $(d\times4)\leqq h\leqq(d\times5)$, cross talk can be prevented; thus, good ink ejection characteristics can be obtained.

A method for fabricating an ink jet recording head of the present invention will next be described with reference to FIGS. 4 and 5. FIGS. 4 and 5 are series of longitudinal cross-sectional views of the pressure generating chamber 12. In FIGS. 4B to 4D, 5A, and 5B, the pressure generating chamber 12 is represented by the dotted line, since the chamber 12 is not formed yet.

Figure 4A:
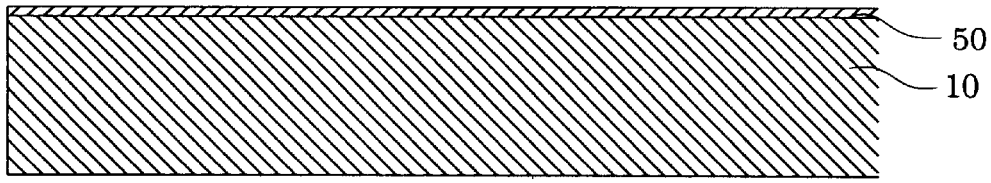
FIGS. 4A to 4D are sectional views showing a process for fabricating the ink-jet recording head of FIG. 1.

First, as shown in FIG. 4A, the elastic film 50 is formed on one side of the passage-forming substrate 10. Specifically, for example, a monocrystalline silicon substrate having a thickness of 220 μm and which will become the passage-forming substrate 10 is thermally oxidized at about 1100° C. in a diffusion furnace, thereby forming the elastic film 50 of silicon dioxide on one side of the passage-forming substrate 10.

Figure 4B:
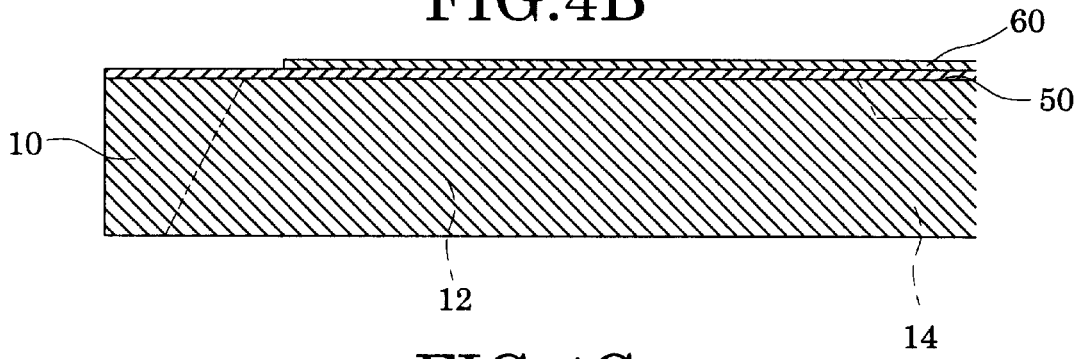

Next, as shown in FIG. 4B, the lower electrode film 60 is deposited on the entire surface of the elastic film 50 through sputtering, followed by patterning into a predetermined pattern. Platinum (Pt) is a preferred material for the lower electrode film 60 for the following reason: a piezoelectric layer 70 to be deposited by a sputtering process or a sol-gel process must be crystallized, after deposition, through firing at a temperature of about 600° C. to 1000° C. in the atmosphere or an oxygen atmosphere. That is, material for the lower electrode film 60 must maintain electrical conductivity in such a high-temperature oxidizing atmosphere. Particularly, when lead zirconate titanate (PZT) serves as the piezoelectric layer 70, the material has desirably slight variation in electrical conductivity caused by diffusion of lead oxide. Thus, platinum is preferred.

Figure 4C:
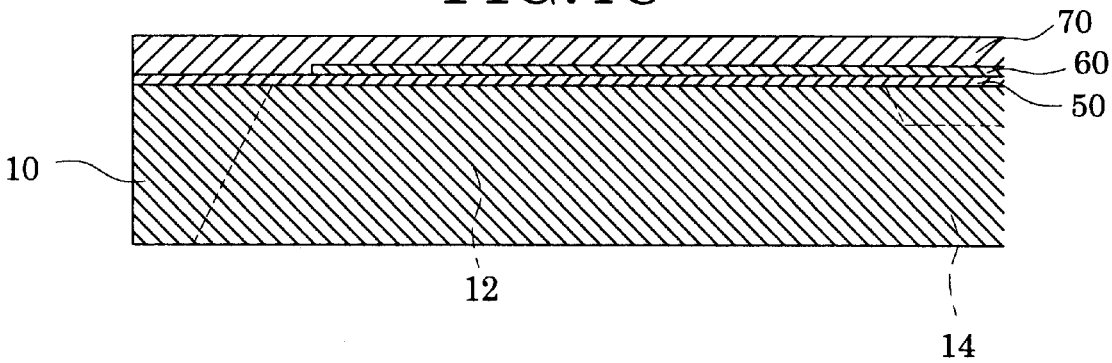

Next, as shown in FIG. 4C, the piezoelectric layer 70 is deposited. Preferably, the piezoelectric layer 70 are crystallographically oriented. For example, according to the present embodiment, the piezoelectric layer 70 is formed in a crystallographically oriented condition by use of a sol-gel process. Specifically, an organic substance of metal is dissolved and dispersed in a catalyst to obtain a so-called sol. The sol is applied and dried to obtain gel. The gel is subjected to firing at high temperature, thereby yielding the piezoelectric layer 70 made of a metallic oxide. In application to an ink-jet recording head, a lead zirconate titanate material is a preferred material for the piezoelectric layer 70. A method for depositing the piezoelectric layer 70 is not particularly limited. For example, a sputtering process may be used.

Alternatively, a precursor of lead zirconate titanate is formed by a sol-gel process or a sputtering process and is then caused to undergo crystal growth in an alkaline aqueous solution at low temperature by use of a high-pressure treatment process.

In contrast to a bulk piezoelectric material, the thus-deposited piezoelectric layer 70 assumes crystallographically preferred orientation. For example, the piezoelectric layer 70 of the present embodiment assumes preferred orientation with respect to (100) planes. Preferred orientation refers to a state in which crystals are orderly oriented; i.e., certain crystal planes face the same direction.

In the piezoelectric layer 70, crystals assume a columnar, rhombohedral form. A thin film of columnar crystals refers to a state in which substantially cylindrical crystals are collected along the planar direction while axes thereof extend substantially along the thickness direction thereof, to thereby form a thin film. Of course, a thin film may be formed of granular crystals of preferred orientation. A piezoelectric layer deposited by such a thin film deposition process generally assumes a thickness of 0.2 μm to 5 μm.

Figure 4D:
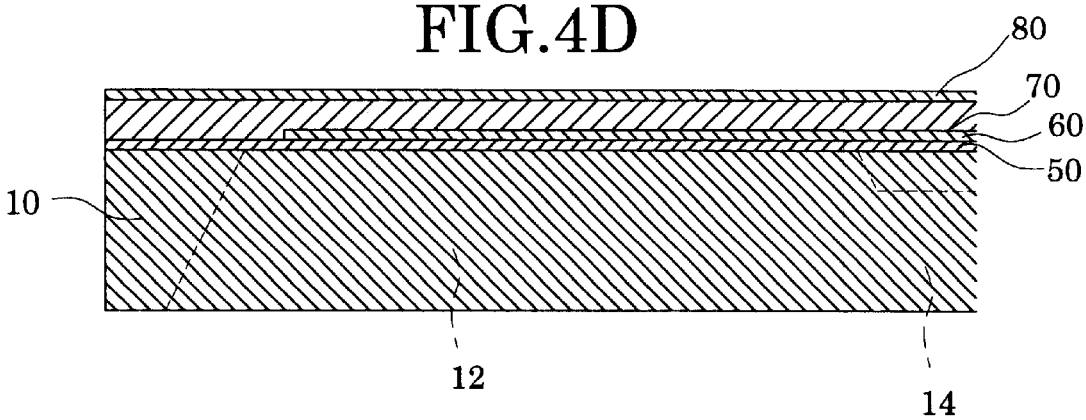

Next, as shown in FIG. 4D, the upper electrode film 80 is formed. The upper electrode film 80 may be made of any material of high electrical conductivity, such as aluminum, gold, nickel, platinum, or a like metal, or an electrically conductive oxide. According to the present embodiment, platinum is deposited through sputtering.

Figure 5A:
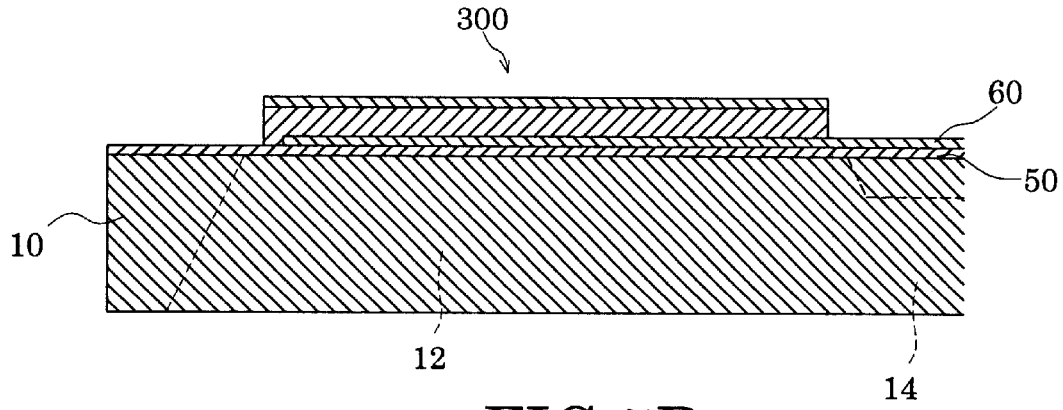
FIGS. 5A to 5D are sectional views showing a process for fabricating the ink-jet recording head of FIG. 1.

Next, as shown in FIG. 5A, the piezoelectric layer 70 and the upper electrode film 80 undergo patterning to thereby form the piezoelectric elements 300 in regions that face the pressure generating chambers 12.

Figure 5B:
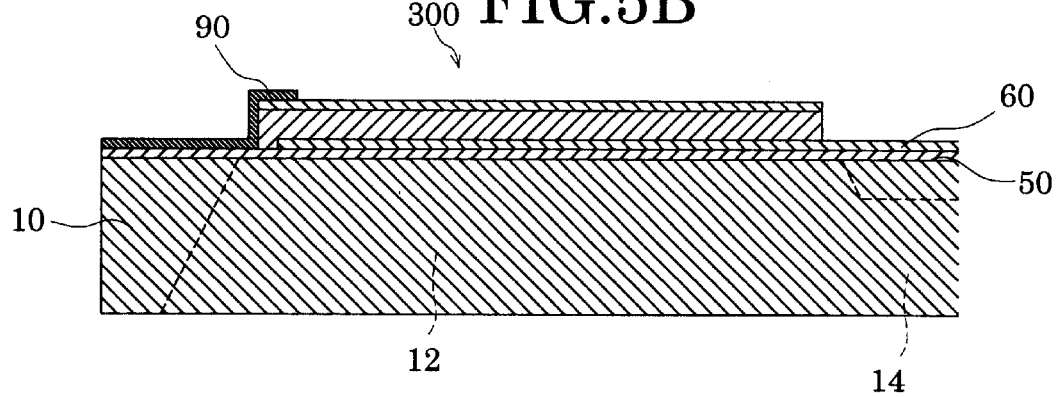

Next, as shown in FIG. 5B, lead electrodes 90 are formed. Specifically, the lead electrode 90 made of, for example, gold (Au) is formed on the passage-forming substrate 10 along the entire width of the substrate 10 and then undergoes patterning to thereby be divided into the individual lead electrodes 90 corresponding to the piezoelectric elements 300.

Figure 5C:
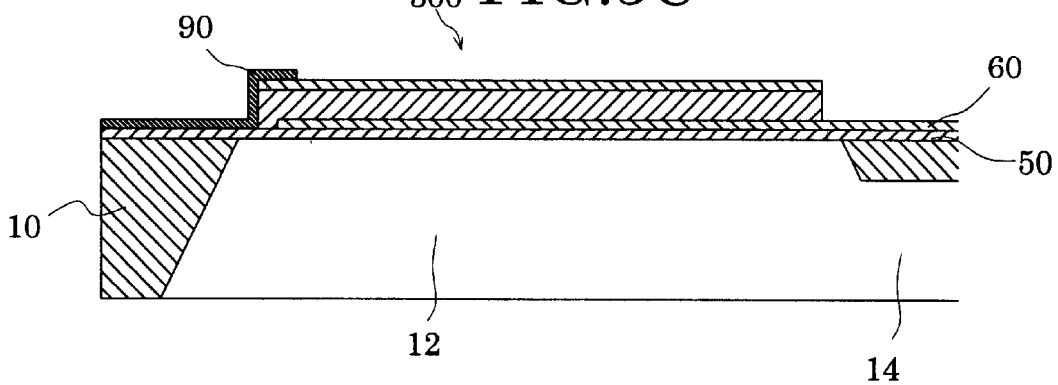

After the above-described film deposition process, as described previously, the monocrystalline silicon substrate is anisotropically etched by use of an alkaline solution, whereby, as shown in FIG. 5C, the pressure generating chambers 12, the ink supply paths 14, and the unillustrated communication sections 13 are formed simultaneously.

Figure 5D:
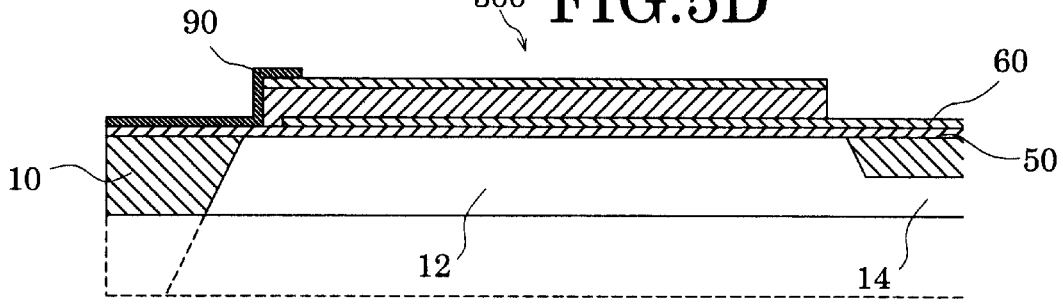

Subsequently, as shown in FIG. 5D, the opposite surface of the passage-forming substrate 10 to the piezoelectric elements 300 is polished such that the passage-forming substrate 10 assumes a predetermined thickness of, for example, about 70 μm in the present embodiment.

According to the present embodiment, the passage-forming substrate 10 is polished so as to assume a predetermined thickness. However, the passage-forming substrate 10 may assume a predetermined thickness beforehand. In this case, since a process for forming the piezoelectric elements 300 encounters difficulty in handling the passage-forming substrate 10, for example, a sacrificial wafer having a thickness of about 200 μm may be bonded to one side of the passage-forming substrate 10 (silicon wafer), and, at a certain later stage, the sacrificial wafer may be removed.

In fabrication, a number of chips each including the piezoelectric elements 300 and the pressure generating chambers 12 are simultaneously formed on a single wafer by a series of film deposition processes and a subsequent anisotropic etching process. Then, a nozzle plate 20 is bonded to the wafer. The thus-prepared wafer is divided into chip-sized passage-forming substrate s 10, as shown in FIG. 1. A reservoir forming plate 30 and a compliance substrate 40, which will be described later, are sequentially bonded to each of the passage-forming substrates 10. The resultant unit becomes an ink-jet recording head.

As shown in FIGS. 1 to 3, the reservoir forming plate 30 including the reservoir 31, which is provided for common use among the pressure generating chambers 12, is bonded to the side of the piezoelectric elements 300 of the passage-forming substrate 10 including the pressure generating chambers 12. In the present embodiment, the reservoir 31 is formed in the reservoir forming plate 30 in such a manner as to extend through the reservoir forming plate 30 in the thickness direction of the substrate 30 while extending along the direction along which the pressure generating chambers 12 are arranged.

Preferably, the reservoir forming plate 30 is made of a material having a thermal expansion coefficient substantially equal to that of the passage-forming substrate 10; for example, glass or a ceramic material. In the present embodiment, the reservoir forming plate 30 and the passage-forming substrate 10 are formed of the same material; i.e., a monocrystalline silicon substrate. Thus, as in the case of bonding of the nozzle plate 20 and the passage-forming substrate 10, even when the reservoir forming plate 30 and the passage-forming substrate 10 are bonded at high temperature by use of a thermosetting adhesive, they can be bonded reliably. Thus, a fabrication process can be simplified.

Further, the compliance substrate 40, which includes a sealing film 41 and a fixture plate 42, is bonded to the reservoir forming plate 30. The sealing film 41 is formed of a low-rigidity material having flexibility (e.g., polyphenylene sulfide (PPS) film having a thickness of 6 μm). The sealing film 41 seals one side of the reservoir 31. The fixture plate 42 is formed of a hard material, such as metal, (e.g., a stainless steel (SUS) plate having a thickness of 30 μm). A region of the fixture plate 42 that faces the reservoir 31 is completely removed in the thickness direction of the fixture plate 42 to thereby form an opening 43. As a result, one side of the reservoir 31 is covered merely with the flexible sealing film 41 to thereby form a flexible section 32, which is deformable according to a change in the inner pressure of the reservoir 31.

An ink inlet 35, through which ink is supplied to the reservoir 31, is formed in the compliance substrate 40 and is located at a substantially central portion with respect to the longitudinal direction of the reservoir 31 and outside the reservoir 31 with respect to the lateral direction of the reservoir 31. Further, an ink introduction channel 36 for establishing communication between the ink inlet 35 and the reservoir 31 is formed in the reservoir forming plate 30 while extending through the sidewall of the reservoir 31.

A piezoelectric element holding portion 33 is formed in a region of the reservoir forming plate 30 which faces the piezoelectric elements 300, in such a manner as to provide a space, in a sealed condition, for allowing free movement of the piezoelectric elements 300. The piezoelectric elements 300 are sealed in the piezoelectric element holding portion 33, whereby the piezoelectric elements 300 are protected from fracture which would otherwise result from environmental causes, such as water in the atmosphere.

The thus-configured ink-jet recording head operates in the following manner. Unillustrated external ink supply means is connected to the ink inlet 35 and supplies ink to the ink-jet recording head through the ink inlet 35. The thus-supplied ink fills an internal space extending from the reservoir 31 to the nozzle orifices 21. In accordance with a record signal from an unillustrated external drive circuit, voltage is applied between an upper electrode film 80 and the lower electrode film 60, thereby causing the elastic film 50, the lower electrode film 60, and a corresponding piezoelectric layer 70 to be deformed. As a result, pressure within a corresponding pressure generating chamber 12 increases to thereby eject a droplet of ink from a corresponding nozzle orifice 21.

While the present invention has been described with reference to the embodiment, the basic configuration of an ink-jet recording head is not limited to that of the embodiment.

For example, the above embodiment is described while mentioning a thin-film-type ink-jet recording head, whose fabrication employs a film deposition process and a lithography process. However, the present invention is not limited thereto. For example, the present invention may be applicable to a thick-film-type ink-jet recording head, whose fabrication employs affixing of a green sheet.

Also, the above embodiment is described while mentioning an ink-jet recording head including deformation-type piezoelectric elements. However, the present invention is not limited thereto. For example, the present invention may be applicable to an ink-jet recording head including piezoelectric elements operating in longitudinal oscillation mode, which piezoelectric elements are each configured such that a piezoelectric material and an electrode material are arranged in an alternatingly layered structure. In either case, an vibration plate must undergo tensile stress.

The present invention may be applicable to ink-jet recording heads of various structures without departing from the spirit or scope of the invention.

Figure 6:
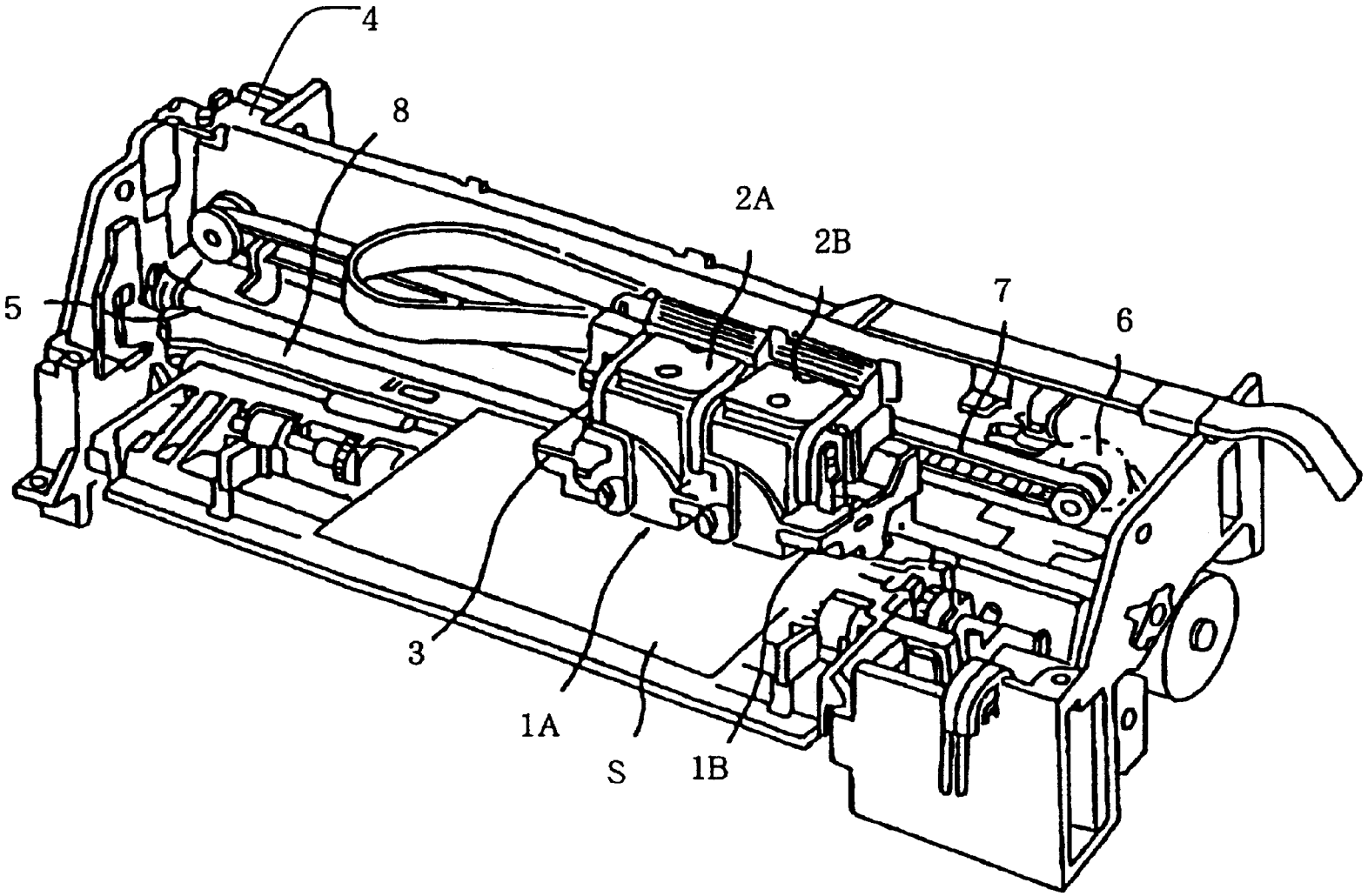
FIG. 6 is a schematic view of an ink-jet recording apparatus according to an embodiment of the present invention.

The ink-jet recording head of the embodiment as described above partially constitutes a recording head unit including an ink channel communicating with an ink cartridge or a like device to thereby be mounted on an ink-jet recording apparatus. FIG. 6 schematically shows an embodiment of such an ink-jet recording apparatus.

As shown in FIG. 6, recording head units 1A and 1B each including an ink-jet recording head removably carry cartridges 2A and 2B, respectively, serving as ink supply means. A carriage 3 that carries the recording head units 1A and 1B is axially movably mounted on a carriage shaft 5, which is attached to an apparatus body 4. The recording head units 1A and 1B are adapted to eject, for example, a black ink composition and a color ink composition, respectively.

Driving force of a drive motor 6 is transmitted to the carriage 3 via a plurality of unillustrated gears and a timing belt 7, whereby the carriage 3, which carries the recording head units 1A and 1B, moves along the carriage shaft 5. A platen 8 is provided on the apparatus body 4 in such a manner as to extend along the path of the carriage 3. The platen 8 is rotated by means of driving force of an unillustrated paper feed motor, whereby a recording sheet S, which is a recording medium, such as paper fed by means of paper feed rollers, is conveyed onto the same.

What is claimed is:

1. An ink-jet recording head comprising:

a passage-forming substrate having a plurality of pressure generating chambers communicating with corresponding nozzle orifices and separated from one another by means of a plurality of compartment walls; and a plurality of piezoelectric elements provided on one side of said passage-forming substrate via an vibration plate and each comprising a lower electrode, a piezoelectric layer, and an upper electrode, wherein said vibration plate undergoes tensile stress; the number n of said pressure generating chambers arranged per inch is more than 200 and is related to width w of said pressure generating chamber and thickness d of said compartment wall as represented by (w+d)=1 inch/n; and the thickness d of said compartment wall is more than 10 $\mu$m and is related to thickness h of said passage-forming substrate as represented by $(d\times3)\leqq h\leqq(d\times6)$.

2. An ink-jet recording head according to claim 1, wherein the thickness h of said passage-forming substrate and the thickness d of said compartment wall are related as represented by $(d\times4)\leqq h\leqq(d\times5)$.

3. An ink-jet recording head according to claim 1, wherein the percentage of compliance of said compartment wall to that of said pressure generating chamber is not greater than 10%.

4. An ink-jet recording head according to claim 1, wherein the thickness h of said passage-forming substrate is more than the width w of said pressure generating chamber.

5. An ink-jet recording head according to claim 1, wherein crystals of said piezoelectric layer assume preferred orientation.

6. An ink-jet recording head according to claim 5, wherein crystals of said piezoelectric layer assume preferred orientation with respect to (100) planes.

7. An ink-jet recording head according to claim 5, wherein crystals of said piezoelectric layer are rhombohedral.

8. An ink-jet recording head according to claim 5, wherein crystals of said piezoelectric layer a re columnar.

9. An ink-jet recording head according to claim 1, wherein said piezoelectric layer assumes a thickness of 0.5 $\mu$m to 2 $\mu$m.

10. An ink-jet recording head according to claim 1, wherein the sum of the stress of said vibration plate and stresses of component layers of each of said piezoelectric elements is equivalent to tensile stress.

11. An ink-jet recording head according to claim 10, wherein the sum of the stress of said vibration plate and stress of said lower electrode is equivalent to tensile stress.

12. An ink-jet recording head according to claim 10, wherein said piezoelectric layer undergoes tensile stress.

13. An ink-jet recording head according to claim 10, wherein said vibration plate comprises a compression layer undergoing compression stress on the side facing said pressure generating chambers.

14. An ink-jet recording head according to claim 1, wherein, when said pressure generating chambers are formed, said piezoelectric elements are convexly warped toward corresponding pressure generating chambers.

15. An ink-jet recording head according to claim 1, said passage-forming substrate is formed of a monocrystalline silicon substrate and is formed to a predetermined thickness through the other side thereof being polished.

16. An ink-jet recording head according to claim 1, said passage-forming substrate is formed of a monocrystalline silicon substrate and is formed to a predetermined thickness through a previously provided sacrificial substrate being removed from the other side thereof.

17. An ink-jet recording head according to claim 1, said pressure generating chambers are formed through anisotropic etching, and component layers of said piezoelectric elements are formed through film deposition and lithography.

18. An ink-jet recording apparatus comprising an ink-jet recording head according to any one of claims 1 to 17.

* * * * *